US006934395B2

(12) United States Patent
Ito

(10) Patent No.: US 6,934,395 B2
(45) Date of Patent: Aug. 23, 2005

(54) SURROUND SOUND FIELD REPRODUCTION SYSTEM AND SURROUND SOUND FIELD REPRODUCTION METHOD

(75) Inventor: Akitaka Ito, Kanagawa (JP)

(73) Assignee: Sony Corporation, Tokyo (JP)

( * ) Notice: Subject to any disclaimer, the term of this patent is extended or adjusted under 35 U.S.C. 154(b) by 544 days.

(21) Appl. No.: 10/145,162

(22) Filed: May 13, 2002

(65) Prior Publication Data

US 2002/0172370 A1 Nov. 21, 2002

(30) Foreign Application Priority Data

May 15, 2001 (JP) ..... P2001-144517

(51) Int. Cl.[7] ..... H04R 5/00
(52) U.S. Cl. ..... 381/23
(58) Field of Search ..... 381/17–23

(56) References Cited

U.S. PATENT DOCUMENTS 5,857,026 A * 1/1999 Scheiber ..... 381/23
6,072,878 A * 6/2000 Moorer ..... 381/18
6,507,658 B1 * 1/2003 Abel et al. ..... 381/17
6,665,407 B1 * 12/2003 Dicker et al. ..... 381/23
6,694,027 B1 * 2/2004 Schneider ..... 381/20

* cited by examiner

*Primary Examiner*—Brian Tyrone Pendleton
(74) *Attorney, Agent, or Firm*—Frommer Lawrence & Haug LLP; William S. Frommer

(57) ABSTRACT

A surround sound field reproduction system and method is disclosed by which, in such a case that a listener changes its posture so that a portion of a video image to which attention should be paid may be observed in front of the listener, a sound image can be localized accordingly in a direction in which the video image is observed in front of the listener. Specifically, the surround sound field reproduction apparatus includes a plurality of horizontal panners for receiving a plurality of sound signals from microphones disposed horizontally and cooperating with each other to control the horizontal localization, and a vertical panner for receiving sound signals from microphones disposed vertically to control the vertical localization. The horizontal panners level-distribute the received sound signals to a plurality of output channels provided corresponding to surround reproduction output channels. The vertical panner changes the level distribution of the sound signals in the vertical direction to produce a sound signal and outputs the produced sound signal to an output channel for the front center.

12 Claims, 14 Drawing Sheets

SURROUND SOUND FIELD REPRODUCTION SYSTEM AND SURROUND SOUND FIELD REPRODUCTION METHOD

BACKGROUND OF THE INVENTION

This invention relates to a surround sound field reproduction system, and more particularly to a surround sound field reproduction system and a surround sound field reproduction method wherein omnidirectionally collected sounds are inputted and that one of the sounds to which the listener is directed is localized forwardly.

Conventionally, a multi-channel surround system is employed in a movie theater and allows reproduction of surround sounds full of presence together with a video image reflected on a screen of a large size. Such surround sound field reproduction as is employed in a movie theater is being popularized also in ordinary homes.

In order to regenerate a surround sound field space, a source and a system for reproducing the source are required. The source may be a video disk such as a DVD (Digital Versatile Disk), a DVD-ROM (Digital Versatile Disk Read Only Memory), a cable system, a satellite broadcast or a digital television broadcast, and also an Internet broadcast may be applicable. Popularly, a 5.1 channel surround system is used as a reproduction system. The 5.1 channel surround system includes an apparatus which serves as a source and speakers for 6 channels in the maximum. The speakers include speakers disposed at left, right and central positions forwardly of the listener, speakers disposed at left and right positions backwardly of the listener, and a subwoofer speaker for applying a heavy bass boosting effect.

The listener usually listens to surround sounds while observing, at the center surrounded by the speakers, a video monitor installed in the proximity of the speaker for the forward center. This is because it is designed by its designer with an intention that it is most effective to enjoy the image and the sound at the position.

However, since the conventional surround reproduction regenerates a sound field produced with the intention of the designer, for example, in such a case that the listener enjoys an omnidirectional video image and particularly observes a portion of the video image from which sound is emitted in the front of the listener, the listener changes its posture for observation of the image in accordance with the direction of the sound source. However, since the sound image remains localized at the forward center, the video image and the sound do not match each other. Therefore, the conventional surround reproduction is disadvantageous in that the listener suffers from an unfamiliar feeling in enjoyment of a video image.

SUMMARY OF THE INVENTION

It is an object of the present invention to provide a surround sound field reproduction system and a surround sound field reproduction method by which, in such a case that a listener changes its posture so that a portion of a video image to which attention should be paid may be observed in front of the listener, a sound image can be localized accordingly in a direction in which the video image is observed in front of the listener.

In order to attain the object described above, according to an aspect of the present invention, there is provided a surround sound field reproduction system for forwardly localizing a sound to which a listener is directed from among omnidirectionally collected sounds, including a plurality of horizontal panner means for individually receiving a plurality of sound signals of different input channels collected from sound sources distributed in a range of 360 degrees in a horizontal direction and distributing sound levels of the sound signals of the input channels in an interlocking relationship with each other to a plurality of output channels to control the horizontal localization, and vertical panner means for receiving a plurality of sound signals of different input channels collected from sound sources distributed in a range of 180 degrees in a vertical direction, changing a level distribution of the sound signals of the input channels to produce a sound signal and outputting the produced sound signal to an output channel for the front center to control the vertical localization.

In the surround sound field reproduction system, of omnidirectionally collected sounds, the sounds in the horizontal direction are distributed to the plurality of output channels by the respective horizontal panner means, and the sounds in the vertical direction are distributed to the output channel for the forward center with the level distribution thereof changed by the vertical panner means. Consequently, the omnidirectionally collected sounds can be selected successively or instantaneously in accordance with the direction in which the listener wants to listen to the sound by means of the horizontal panner means and the vertical panner means, and the sound to which the listener is directed can be localized at the forward center and the relating peripheral sounds can be reproduced in a surround sound field.

If the horizontal panner means and the vertical panner means are disposed on the reception side or the transmission side of an interactive broadcast (the Internet) and direction inputting means for operating the horizontal panner means and the vertical panner means is disposed on the reception side, then it is possible to supply omnidirectionally collected sounds as they are to a listener so that a surround sound field may be produced together with the sound to which the listener is directed on an information terminal on the listener side or for the supply side to produce a surround sound field from omnidirectionally collected sounds together with the sound to which a listener is directed through remote control from the listener.

Further, the number of sound sources in the horizontal direction can be changed systematically using the mixing bus configuration corresponding to a surround sound field, and increase of the number of sound sources for reproducing a sound field in which a sound to which the listener is directed is made clear can be performed readily.

According to another aspect of the present invention, there is provided a surround sound field reproduction method for forwardly localizing a sound to which a listener is directed from among omnidirectionally collected sounds, including the steps of receiving a plurality of sound signals of different input channels collected from sound sources distributed in a range of 360 degrees in a horizontal direction and distributing sound levels of the sound signals of the input channels in an interlocking relationship with each other to a plurality of output channels to control the horizontal localization, and receiving a plurality of sound signals of different input channels collected from sound sources distributed in a range of 180 degrees in a vertical direction, changing a level distribution of the sound signals of the input channels to produce a sound signal and outputting the produced sound signal to an output channel for the front center to control the vertical localization.

In the surround sound field reproduction method, of omnidirectionally collected sounds, the sound signals in the horizontal direction are distributed to the plurality of output channels similarly with the sound levels thereof interlocked with each other, and the sound signals in the vertical direction are distributed to the output channel for the forward center with the level distribution thereof changed. Consequently, the omnidirectionally collected sounds can be selected successively or instantaneously in accordance with the direction in which the listener wants to listen to the sound, and the sound to which the listener is directed can be localized at the forward center and the relating peripheral sounds can be reproduced in a surround sound field.

The above and other objects, features and advantages of the present invention will become apparent from the following description and the appended claims, taken in conjunction with the accompanying drawings in which like parts or elements denoted by like reference symbols.

DESCRIPTION OF THE PREFERRED EMBODIMENT

In the following, an embodiment of the present invention wherein a surround sound field reproduction system to which the present invention is applied is incorporated in a 5.1 surround system is described. It is to be noted that a subwoofer output of the 5.1 surround system is a channel for outputting low frequency components of all channels and the low frequency components are non-directional and do not contribute to localization of a sound image, and therefore, description of the subwoofer output is described herein only where necessary.

First, sounds of omnidirectional sound collection to be inputted to the surround sound field reproduction system and a principle of sound collection are described.

Figure 1:
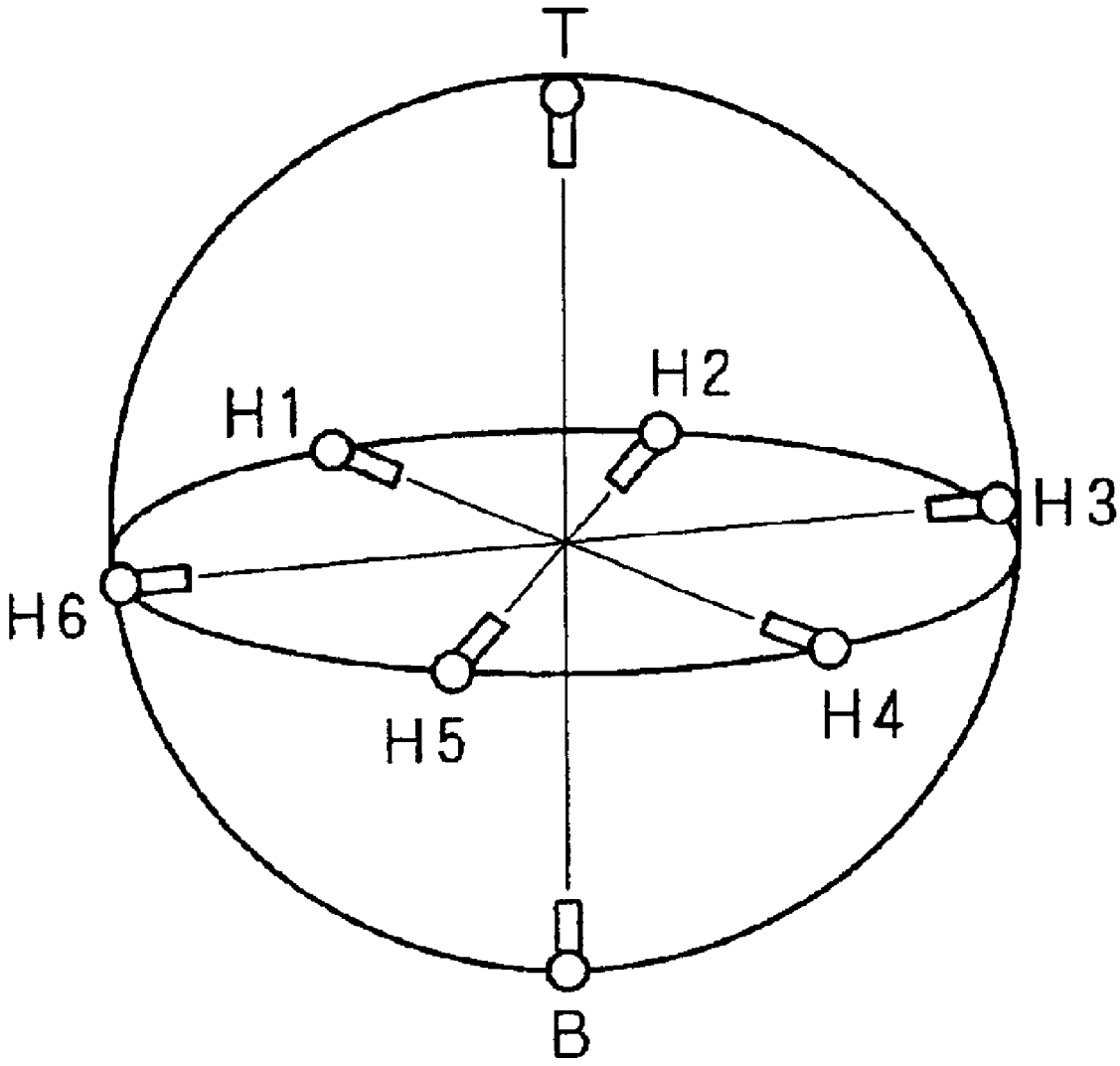
FIG. 1 is a diagrammatic view illustrating an omnidirectional sound collection principle.

FIG. 1 illustrates the principle of omnidirectional sound collection.

In omnidirectional sound collection, sound is collected by a plurality of microphones arranged on an overall celestial sphere. In the arrangement shown in FIG. 1, six microphones H1 to H6 are disposed horizontally at equal distances (60 degrees) in a circumferential direction such that they are directed in radially outward directions, and microphones T and B are disposed vertically at the top and the bottom such that they are directed in upward and downward directions, respectively. The totaling eight microphones H1 to H6, T and B collect sound from all sound sources present in the overall celestial globe.

The sound sources mentioned include sound sources in a sound recording studio, sound sources in an actual live place, sound sources of synthesized sound or virtual sound sources.

Now, the surround sound field reproduction system according to the present invention to which sounds from the eight sound sources described above are inputted is described. It is to be noted that, in the following description, also sound signals obtained by the microphones H1 to H6, T and B described above are denoted by like reference characters.

Figure 2:
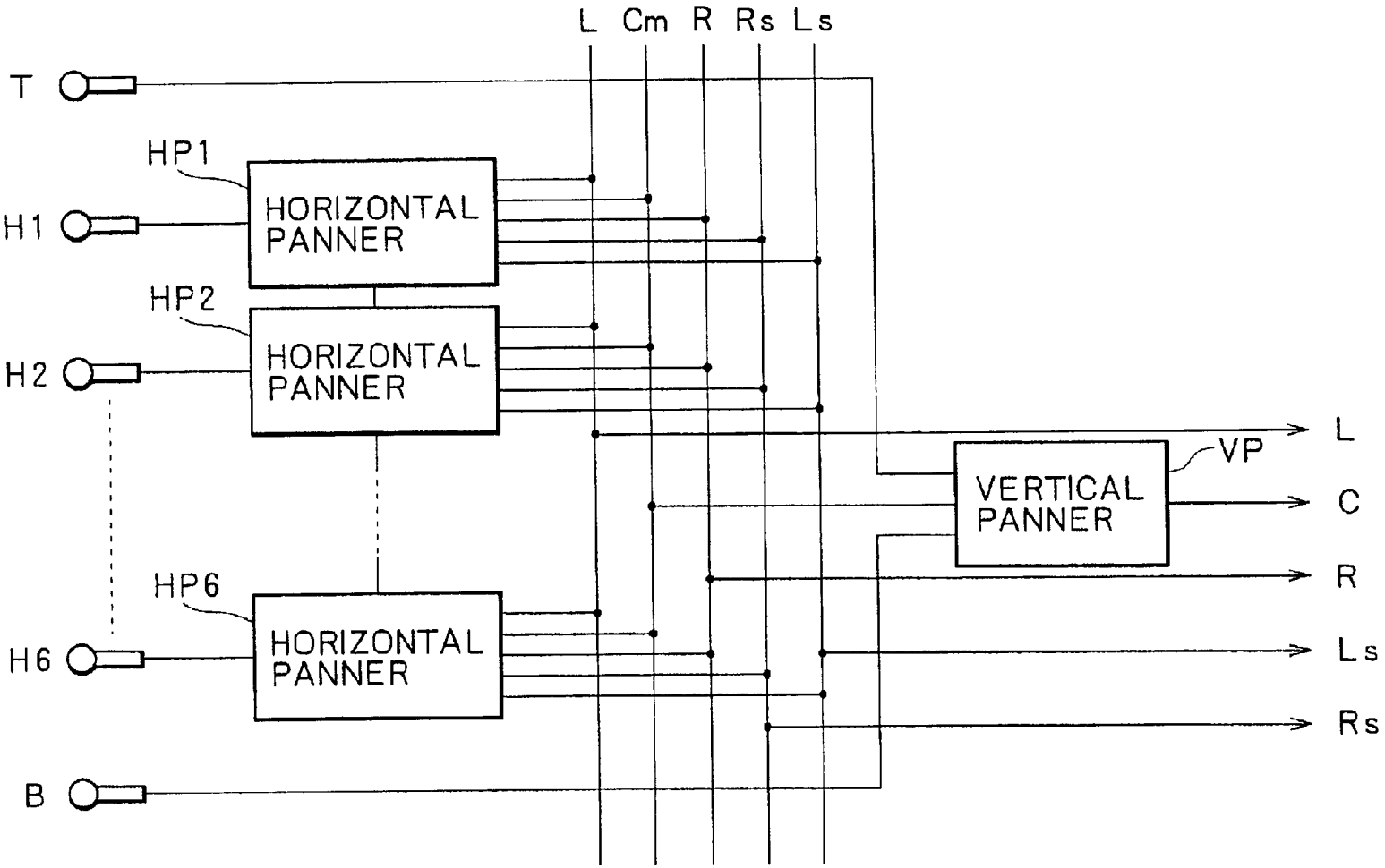
FIG. 2 is a block diagram showing a configuration in principle of a surround sound field reproduction system according to the present invention.

FIG. 2 illustrates a configuration in principle of the surround sound field reproduction system according to the present invention.

Referring to FIG. 2, the surround sound field reproduction system according to the present invention includes six horizontal panners HP1 to HP6 for receiving output sound signals from the six microphones H1 to H6 for the horizontal direction to control horizontal localization, respectively. The horizontal panners HP1 to HP6 are connected such that they operate in an interlocking relationship with each other and outputs thereof are level-distributed to five mixing buses L, Cm, R, Rs and Ls.

The mixing buses L, Cm, R, Rs and Ls are provided corresponding to surround reproduction output channels L, C, R, Ls and Rs (in the following description, corresponding mixing buses, surround reproduction output channels and sound signals may be denoted by like reference characters). In particular, the mixing bus L corresponds the output channel L for the forward left, the mixing bus Cm to the output channel C for the forward center, the mixing bus R to the output channel R for the forward left, the mixing bus Rs to the output channel Rs for the backward right, and the mixing bus Ls to the output channel Ls for the backward left. It is to be noted that, since, from the number of microphones, the present arrangement does not include a microphone which is directed to the forward center, the sound signal Cm for the forward center in the horizontal direction is mixed in the mixing bus Cm.

The surround sound field reproduction system includes a vertical panner VP for receiving output sound signals of the microphone T for upper sound collection and the microphone B for lower sound collection of the vertical sound sources in omnidirectional sound collection and a signal of the mixing bus Cm to control the vertical localization. An output of the vertical panner VP forms an output channel C for the forward center.

In the surround sound field reproduction system having the configuration described above, by operating the horizontal panners HP1 to HP6 in an interlocking relationship with each other, from among the omnidirectionally collected sounds, that sound in a horizontal direction to which the listener is directed can be localized forwardly. Simultaneously, with regard to the vertical direction, a sound in a vertical direction at the forwardly localized position can be localized at an arbitrary position in the vertical direction by operating the vertical panner VP.

Now, panning in a horizontal direction is described.

Figure 3:
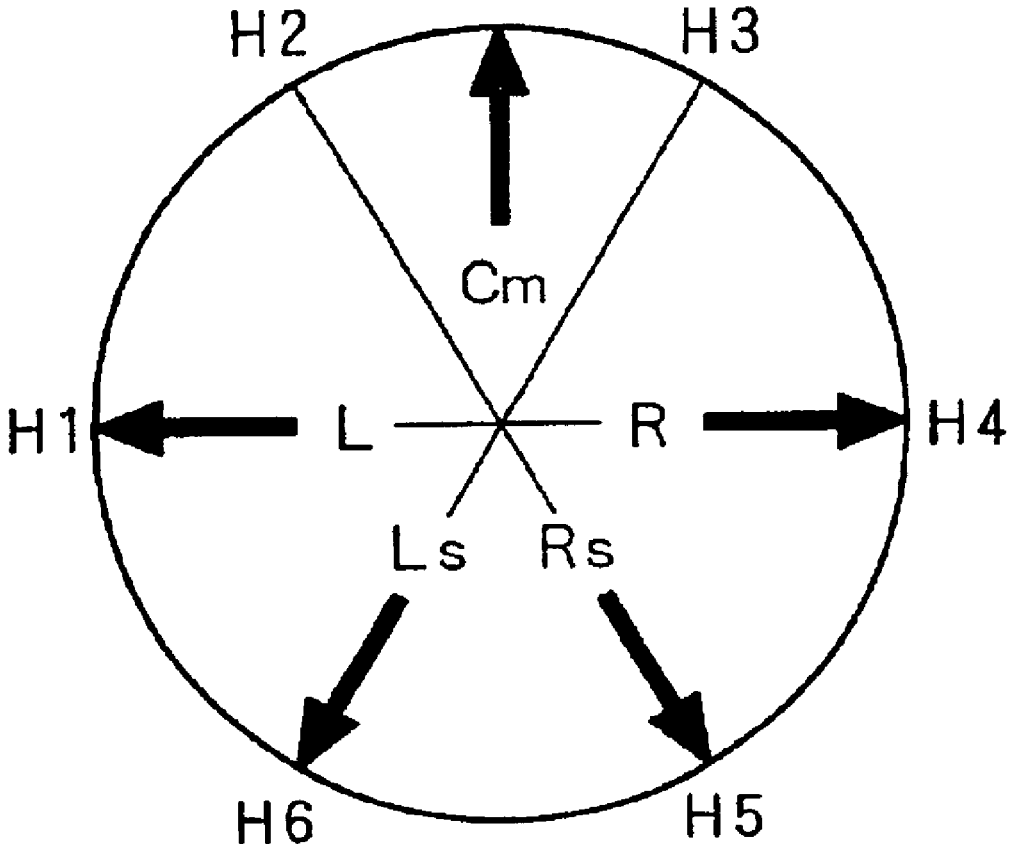
FIG. 3 is a diagrammatic view illustrating a relationship between panning of sound sources in a horizontal direction and a reproduced sound field.

FIG. 3 illustrates a relationship between panning of sound sources in a horizontal direction and a reproduced sound field.

Panning wherein the sound signals H1 to H6 inputted form the microphones H1 to H6 for the horizontal direction are level-distributed to the mixing buses L, Cm, R, Rs and Ls is described in connection with a circle shown in FIG. 2 which illustrates a relationship between the inputted sound signals H1 to H6 and the sound signals L, Cm, R, Rs and Ls produced on the buses.

Since the microphones H1 to H6 are directed in directions equally spaced from each other on a circumference to collect sound from all directions in the horizontal direction, the sound signals H1 to H6 are disposed in an equally spaced relationship from each other on the circumference of the circle shown in FIG. 3.

In contrast, a sound field necessary for surround sound reproduction has relative angles such that, where the upward direction in FIG. 3 is the direction of the front of the system, the sound signal L of the mixing bus L is directed in the leftward direction in FIG. 3; the sound signal Cm of the mixing bus Cm is directed in the forward center direction; the sound signal R of the mixing bus R is directed in the rightward direction; the sound signal Rs of the mixing bus Rs is directed the right backward direction; and the sound signal Ls of the mixing bus Ls is directed to the left backward direction. Naturally, the relative angles mentioned are determined based on the arrangement of speakers and so forth so as to be optimum to the reproduction system and is not limited to the specific example shown in the drawings.

Figure 4:
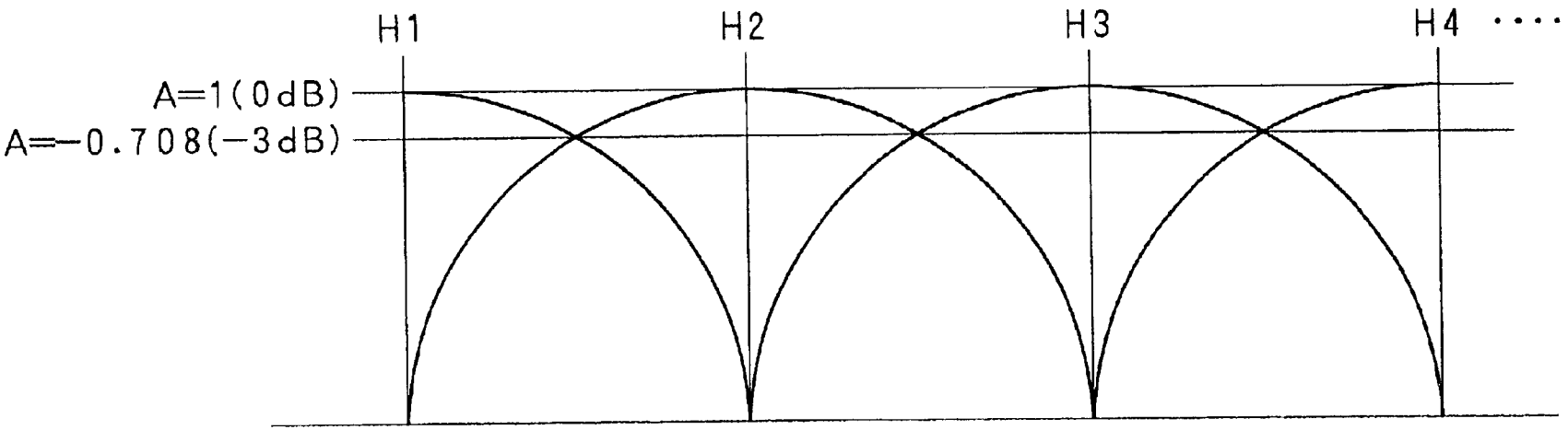
FIG. 4 is a diagram illustrating an attenuation characteristic of panning in a horizontal direction.

FIG. 4 illustrates an attenuation characteristic of panning in the horizontal direction.

Each of the sound signals H1 to H6 in the horizontal direction has a characteristic that it exhibits a gain A equal to 1 and exhibits no attenuation on the directional center line in the horizontal direction in which the microphone H1 to H6 is directed, but attenuates toward the leftward or rightward direction away from the directional center line. Therefore, to the channel at which the position of the inputting sound signal Hx (x=1 to 6) and the surround reproduction output channel L, C, R, Rs or Ls coincide with each other, the sound signal Hx is level-distributed at the level distribution of 1×Hx. Meanwhile, for example, if a certain output channel is midway between H1 and H2, the two input sound signals H1 and H2 are combined at a level distribution of 0.708 times so that the audibility energies thereof may be equal to each other.

Accordingly, in the initial state of the panning in the horizontal direction shown in FIG. 3, the ratios at which the sound signals H1 to H6 are level-distributed to the mixing buses L, Cm, R, Rs and Ls are such as given below:

$$L: 1\times H1 \quad (1)$$

$$Cm: 0.708(H2+H3) \quad (2)$$

$$R: 1\times H4 \quad (3)$$

$$Rs: 1\times H5 \quad (4)$$

$$Ls: 1\times H6 \quad (5)$$

Here, an example of level distribution upon panning in the horizontal direction is described.

Figure 5:
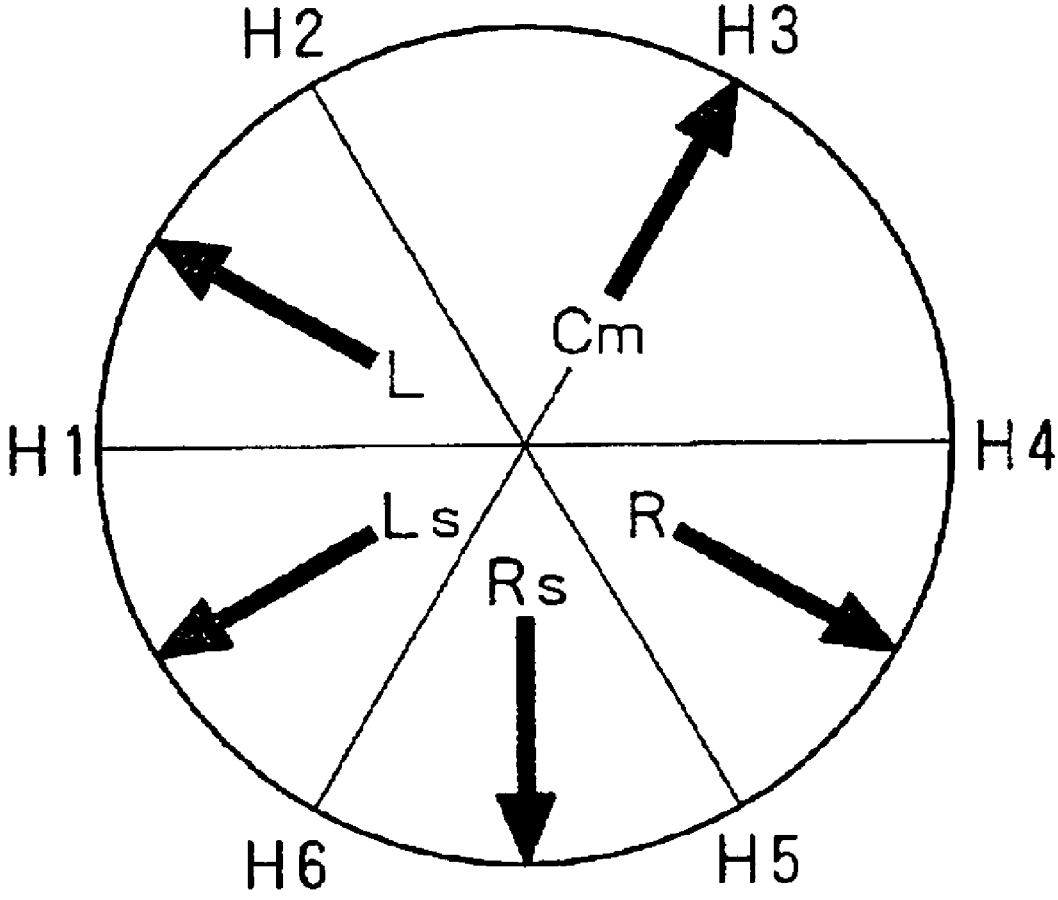
FIG. 5 is a diagrammatic view illustrating a relationship between sound sources in a horizontal direction upon panning and a reproduced sound field.

FIG. 5 illustrates the sound sources in the horizontal direction and a reproduced sound field upon panning.

Referring to FIG. 5, it is assumed that the horizontal panners HP1 to HP6 are operated to move the sound, which should be set to the forward center, by 30 degrees in the rightward direction. The level distribution ratios of the sound signals H1 to H6 to the mixing buses L, Cm, R, Rs and Ls can be determined in the following manner from the attenuation characteristic described hereinabove with reference to FIG. 4:

$$L: 0.708(H1+H2) \quad (6)$$

$$Cm: 1\times H3 \quad (7)$$

$$R: 0.708(H4+H5) \quad (8)$$

$$Rs: 0.708(H5+H6) \quad (9)$$

$$Ls: 0.708(H6+H1) \quad (10)$$

Now, panning in a vertical direction is described.

Figure 6:
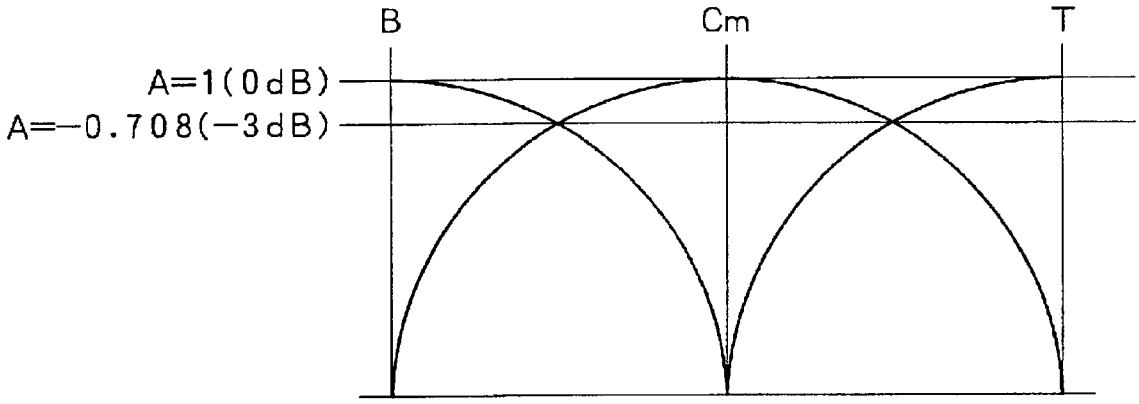
FIG. 6 is a diagram illustrating an attenuation characteristic of panning in a vertical direction.
Figure 7:
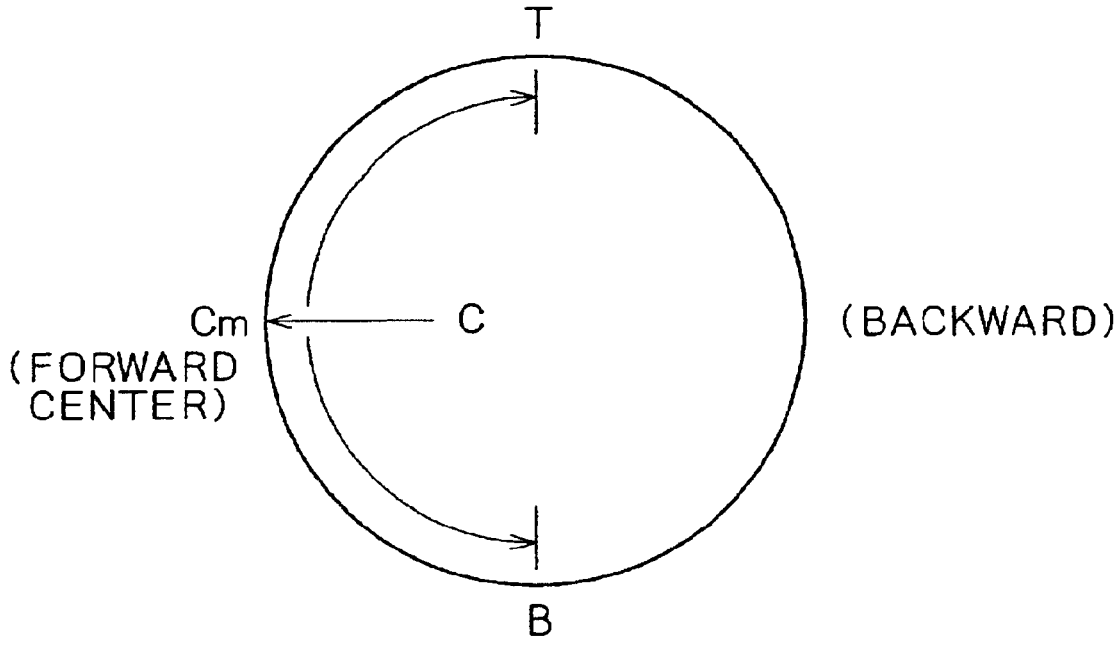
FIG. 7 is a diagrammatic view illustrating a relationship between panning of sound sources in a vertical direction and a reproduced sound field.
Figure 8:
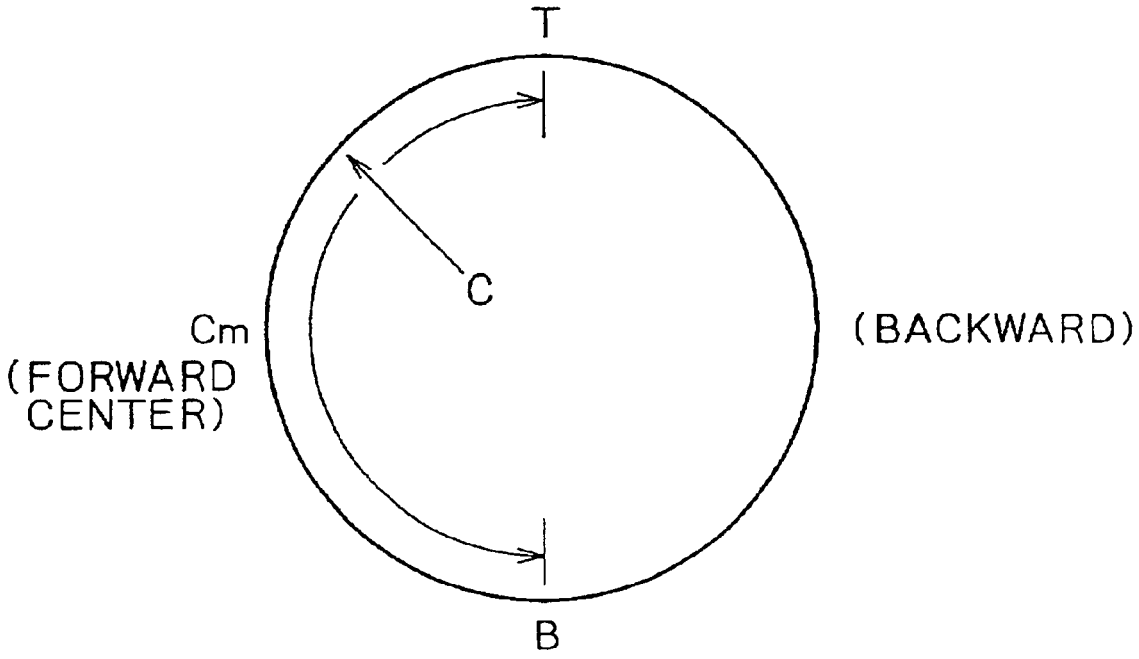
FIG. 8 is a diagrammatic view illustrating a relationship between sound sources in a vertical direction upon panning and a reproduced sound field.

FIG. 6 illustrates an attenuation characteristic of panning in the vertical direction, and FIG. 7 illustrates a relationship between panning of sound sources in the vertical direction and a reproduced sound field while FIG. 8 illustrates a relationship between sound sources in the vertical direction upon panning and a reproduced sound field.

Referring to FIGS. 6 to 8, when an output of the surround reproduction output channel C for the forward center coincides with the sound signal T or B in the vertical direction or the sound signal Cm in the front in the horizontal direction, the sound signal T, Cm or B is outputted as it is without being attenuated. When the output of the surround reproduction output channel C is intermediately between T and Cm or between Cm and B, the two signals are combined such that the sum of the audibility energies of the two signals may always be equal to 1, and a resulting signal is outputted.

For example, upon panning to the center between T and Cm or between Cm and B, the mixing level to be supplied to the surround reproduction output channel from the two sound signals is given by $$C: 0.708(T+Cm) \text{ or } 0.708(Cm+B) \quad (11)$$

Here, the variable range in the vertical direction within which panning is permitted is 180 degrees in the front as seen in FIG. 7. When the vertical panner VP is positioned at a neutral position as seen in FIG. 7, the level distribution between the sound signals T and B in the vertical direction and the sound signal Cm mixed as a forwardly localized sound source in the horizontal direction is given, according to the attenuation characteristic described hereinabove with reference to FIG. 7, by $$C: 1\times Cm \quad (12)$$

If the panning in the vertical direction is moved upwardly by 45 degrees from the horizontal position of FIG. 7 as seen in FIG. 8, then the level distribution to the surround reproduction output channel C of the front center is given, from the attenuation characteristic described hereinabove with reference to FIG. 6, by $$C: 0.708(Cm+T) \quad (13)$$

Now, a particular example from collection to reproduction of sound which implements the surround sound field reproduction system of the present invention is described.

First, omnidirectional sound collection is described. The omnidirectional sound collection uses unidirectional microphones to obtain presence and a directional characteristic so that a good degree of separation between channels can be obtained. For the horizontal direction, as the number of channels for sound collection increases, the microphones to be used must have a sharper unidirectional characteristic.

Sound signals of omnidirectionally collected sound can be recorded or distributed directly. At this time, the sound signals to be recorded or distributed may be in the form of original signals or otherwise in the form of compressed signals.

In order to record sound signals of omnidirectionally collected sound together with, for example, a video signal, a video recorder, a digital video tape recorder (VTR) or a like apparatus is used. However, since the apparatus mentioned have tracks for only two or four channels, the necessary sound channels are distributed to and recorded simultaneously into a plurality of video recorders or digital video tape recorders. At this time, in order to establish synchronism among the channels, the sound channels are recorded with the same time code, for example, the SMPTE (Society of Motion Picture and Television Engineers) time code into the video recorders or digital video tape recorders.

Another recording method may be employed wherein sound signals of omnidirectionally collected sound are recorded as they are using a multi-track recorder. In this instance, where a video signal is recorded, the sound signals and the video signal are all recorded with the same time code.

As a further recording method, sound signals of omnidirectionally collected sound may be compressed into and digitally recorded in 2 channels. As a recording medium in this instance, preferably a digital VTR, a DAT (Digital Audio Tape) recorder, or a HDD (Hard Disk Drive) is used.

In the following description, a system which can compress and record omnidirectionally collected sound and regenerate the recorded sound signals until they can be applied to the surround sound field reproduction system according to the present invention is described.

Figure 9:
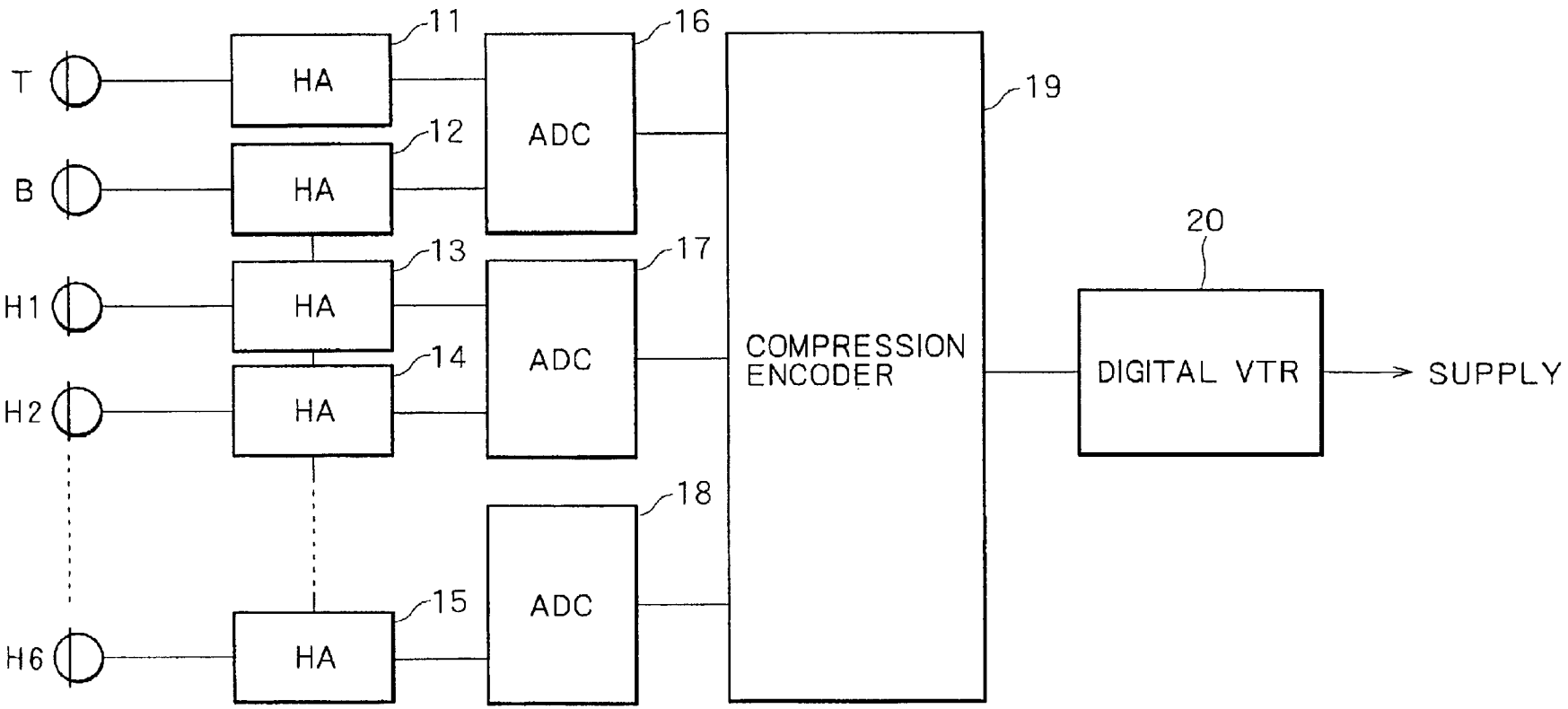
FIG. 9 is a block diagram showing an example of a configuration of a recording system based on omnidirectional sound collection.

FIG. 9 shows an example of a configuration of a recording system based on omnidirectional sound collection.

In order to regenerate sound of omnidirectionally distributed sound sources with fidelity as high as possible, it is necessary to record the sound with a number of channels as many as possible. However, from the overall efficiency in configuration of the system, it is assumed here that omnidirectionally collected sound is recorded in totaling eight channels and sound sources of 8 channels supplied suitably from the recorded sound are compatibly converted into 5.1 channel surround signals.

Referring to FIG. 9, the omnidirectionally collected sound recording system includes, at an inputting section thereof, head amplifiers 11, 12, 13, 14 and 15 for receiving sound signals collected by the microphones T and B for the vertical directions the microphones H1 to H6 for the horizontal direction. The head amplifiers 11, 12, 13, 14 and 15 have an AGC (Automatic Gain Control) function of amplifying a received sound signal with a predetermined amplification factor while adjusting the level of the sound signal suitably with respect to the compression level of a dynamic range. The AGC function can be enabled/disabled when necessary, and when it is enabled, the gains of the omnidirectional sound signals and the control amounts of the AGC are interlocked with each other among the head amplifiers 11, 12, 13, 14 and 15 for all channels.

Outputs of the head amplifiers 11, 12, 13, 14 and 15 are connected to inputs of three analog to digital converters 16, 17 and 18 each for 2 channels. Each of the analog to digital converters 16, 17 and 18 converts analog signals of 2 channels into a serial digital signal of, for example, 16 to 24 bits.

Outputs of the analog to digital converters 16, 17 and 18 are inputted to a compression encoder 19 which compresses digitally converted signals of 8 channels into signals of 2 channels. For the compression encoder 19, the "Dolby E" multi-channel coding technique developed by Dolby of the United States is employed. It is to be noted that, as another sound compression apparatus, the sound compression technique "ATRAC (Adaptive TRansform Acoustic Coding)" developed by Sony of Japan may be used.

An output of the compression encoder 19 is connected to a digital VTR 20 through an AES/EBU (Audio Engineering Society/European Broadcasting Union) twisted pair cable which is a digital audio interface for business use.

In the omnidirectionally collected sound recording system having the configuration described above, sound signals collected by the microphones T, B and H1 to H6 are amplified and, when necessary, level-averaged using the AGC function, by the head amplifiers 11, 12, 13, 14 and 15.

Then, the collected sound signals of 8 channels are compressed into signals of 2 channels by the compression encoder 19. The serial digital signals of the 2 channels are recorded on two audio tracks of the digital VTR 20.

Figure 10:
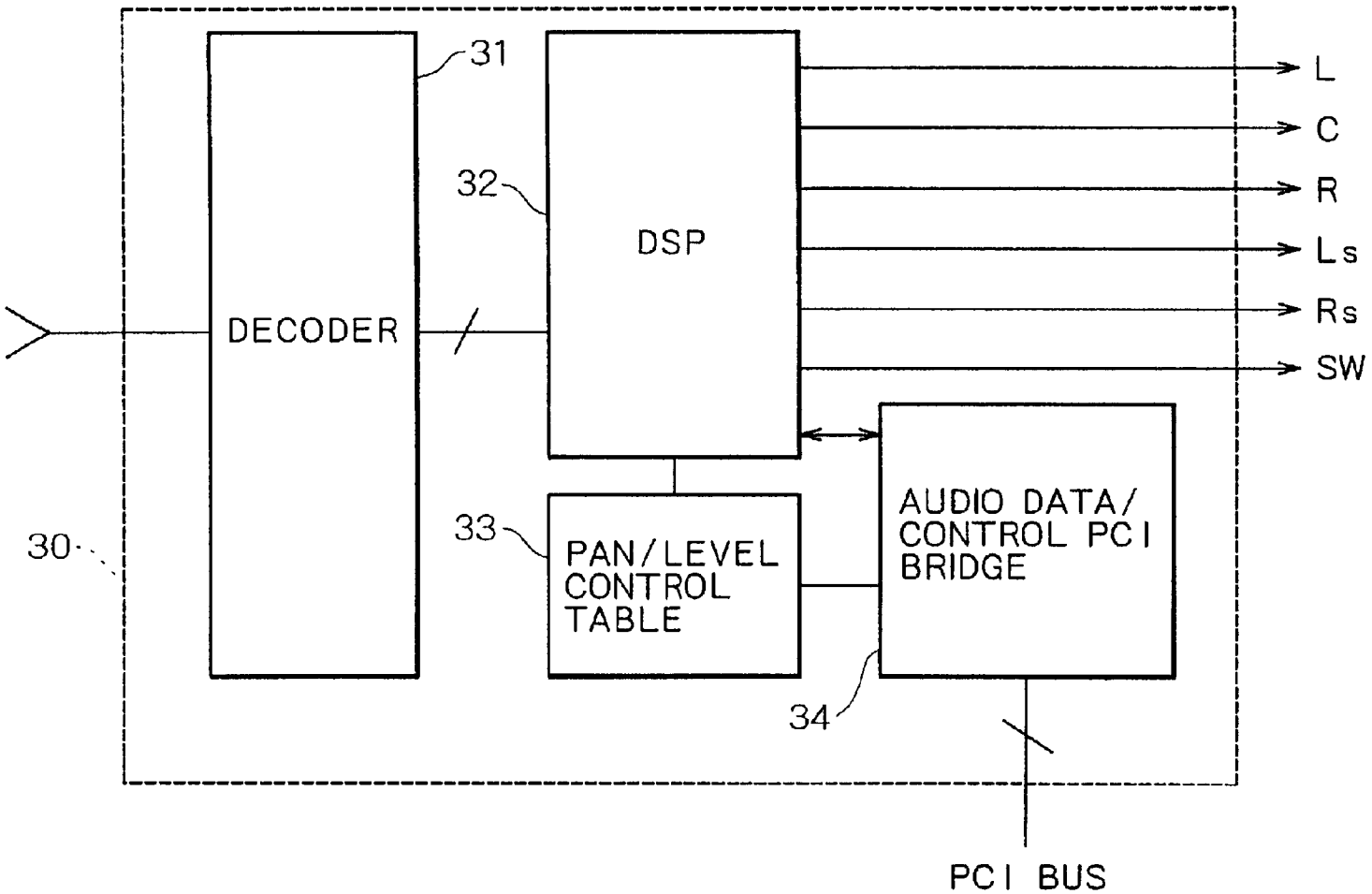
FIG. 10 is a block diagram showing an example of a system configuration of an omnidirectional surround reproduction apparatus.

FIG. 10 shows an example of a system configuration of the omnidirectional surround reproduction apparatus.

Referring to FIG. 10, in the example shown, functions of the omnidirectional surround reproduction apparatus are mounted on an audio decoder board 30 incorporated in a personal computer. The audio decoder board 30 includes a decoder 31 to which, for example, signals recorded on the digital VTR 20 shown in FIG. 9 or signals received on the real-time basis are inputted. The decoder 31 has a function of decoding 2-channel serial digital signals of the compression format inputted thereto into four 2-channel serial digital audio signals using a decoding technique of the "Dolby E" compression format. Outputs of the decoder 31 are connected to inputs of a DSP (Digital Signal Processor) 32. The DSP 32 has a function of processing four 2-channel serial digital audio signals to produce six surround reproduction output channels L, C, R, Ls, Rs and SW. The surround reproduction output channel SW here is an output channel for subwoofer which takes charge of reproduction of low-frequency components of all of the channels. Accordingly, the six surround reproduction output channels L, C, R, Ls, Rs and SW can be connected directly to an external 5.1 channel surround system.

A pan/level control table 33 is connected to the DSP 32. The pan/level control table 33 stores mixing distribution data to the individual channels corresponding to panning operation amounts in the horizontal and vertical directions performed in accordance with an instruction of the listener, and passes, in response to coordinate data received from a direction inputting apparatus which is hereinafter described, corresponding pan position data for panning control to the DSP 32. The omnidirectional resolution need not be particularly high, and the panning can be controlled with a resolution of, for example, approximately 8 to 20 bits for the entire circumference in the horizontal direction and, for example, approximately 8 bits for the upward and downward range of 180 degrees in the vertical direction.

The DSP 32 is further connected to an audio data/control PCI bridge 34 which performs conversion and transfer of a signal to and from a PCI (Peripheral Component Interconnect) bus of an extension slot of a personal computer.

In the omnidirectional surround reproduction system having the configuration described above, serial digital signals compressed to 2 channels are decompressed and decoded by the decoder 31 so that the collected sound signals of the channels T, B and H1 to H6 are decoded into 2 channels×4 serial digital audio signals.

The four serial digital audio signals obtained by the decoding are mixed into the surround reproduction output channels L, C, R, Ls, Rs and SW for the individual directions by the DSP 32. At this time, if a panning instruction is inputted from the direction inputting apparatus through the audio data/control PCI bridge 34, then a mixing control signal corresponding to the instruction is supplied from the pan/level control table 33 to the DSP 32, and the DSP 32 performs a mixing process in accordance with the instruction.

Figure 11:
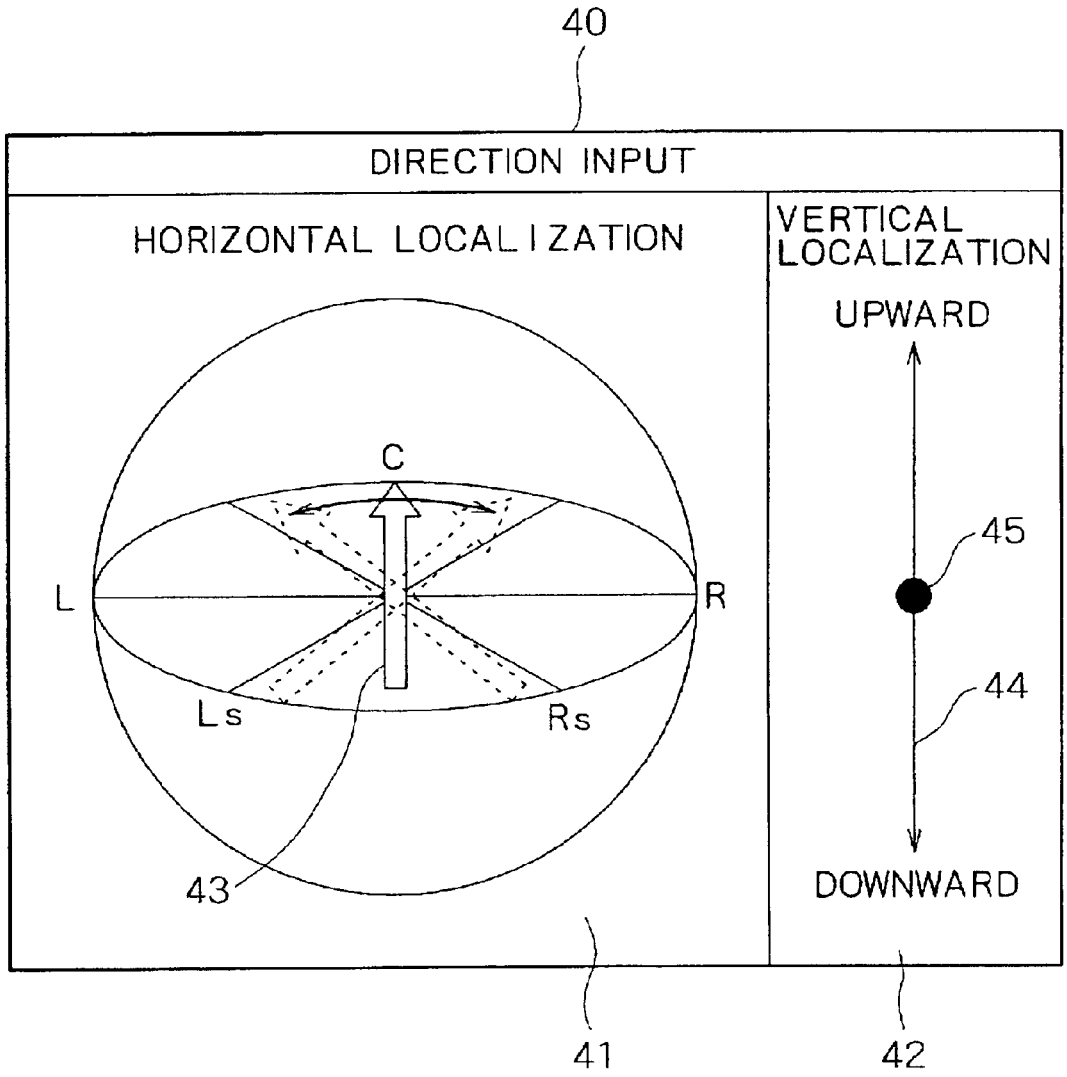
FIG. 11 is a schematic view showing an example of a screen display of a direction inputting apparatus.

FIG. 11 illustrates an example of a screen display of the direction inputting apparatus.

The direction inputting apparatus 40 is used to output a panning instruction to the audio decoder board 30 of the omnidirectional surround reproduction apparatus and is displayed on a screen of a monitor of a personal computer. The screen of the direction inputting apparatus 40 includes a sub screen 41 for setting in a horizontal direction and another sub screen 42 for setting in a vertical direction.

A full direction surround sound field is displayed on the sub screen 41 for horizontal setting through such a bird's-eye view that reproduction positions of the surround reproduction output channels L, C, R, Ls and Rs for the horizontal direction are viewed from an obliquely rearward upward position. At the center at which the listener is positioned, an arrow mark 43 representative of a direction of a sound to be forwardly localized is disposed.

In order to change the direction of the forward localization, the end of the arrow mark 43 is, for example, pointed with a mouse pointer and dragged in the leftward or rightward direction in the thus pointed state. By the operation just described, the direction of the arrow mark 43 can be rotated by 360 degrees, and coordinate information in the horizontal direction inputted in this state is sent to the audio decoder board 30.

The sub screen 42 for vertical setting includes an arrow mark 44 representative of the range of setting in the upward and downward direction and a mark 45 disposed on the line of the arrow mark 44 and representative of the localization in the upward and downward direction. In order to change the localization in the upward or downward direction, the mark 45 is dragged in the upward or downward direction with the mouse pointer. The localization in the upward or downward direction can be inputted in this manner. Also the thus inputted coordinate information is sent to the audio decoder board 30 together with the horizontal input information.

Now, a horizontal panner operation and a vertical panner operation performed in the DSP 32 of the audio decoder board 30 are described. It is to be noted that, in order to facilitate understanding, description is given of a case wherein mixing of inputs for the horizontal and vertical directions to the mixing buses is replaced by an analog volume.

Figure 12:
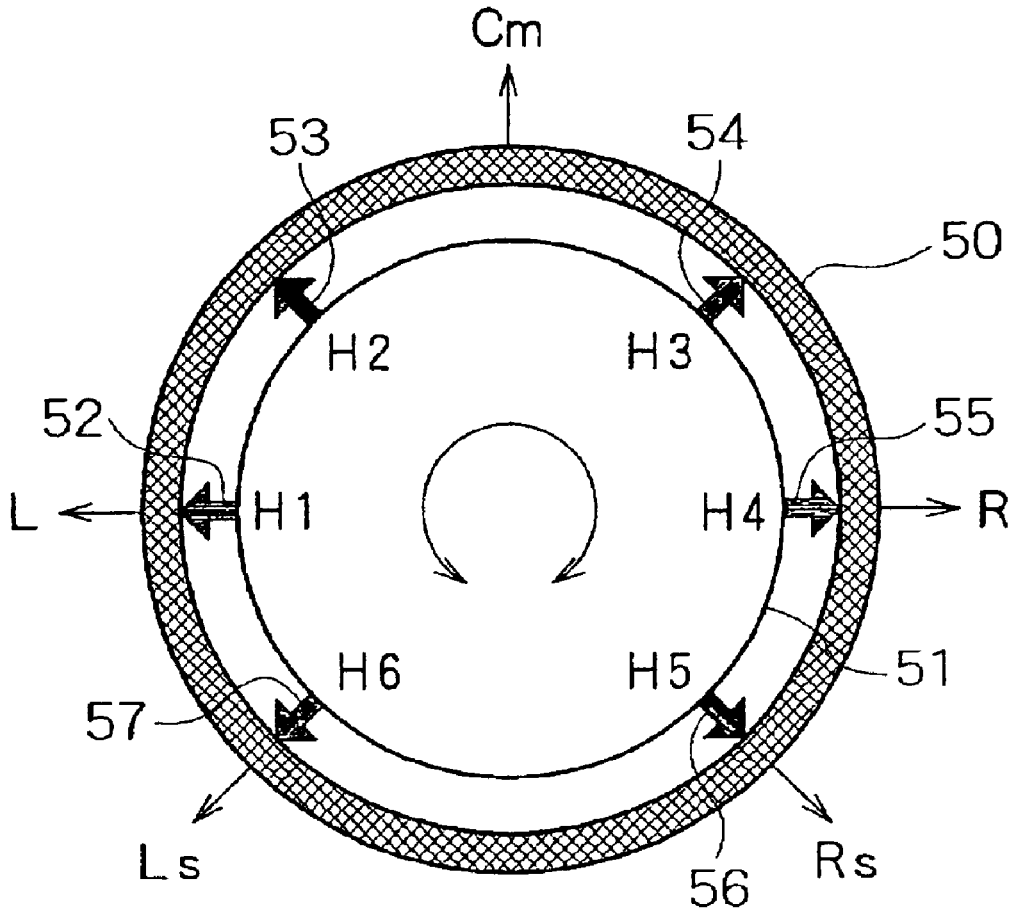
FIG. 12 is a diagrammatic view illustrating a relationship between horizontal direction inputs and mixing buses.

FIG. 12 illustrates a relationship between the horizontal direction inputs and the mixing buses.

The horizontal panner has a resistance member 50 formed in a ring, and the mixing buses L, Cm, R, Rs and Ls are connected to positions on the circumference of the resistance member 50 in the corresponding horizontal directions. Further, a rotor 51 is provided concentrically with the resistance member 50 such that it can rotate in response to a horizontal instruction input of the direction inputting apparatus 40, and movable pieces 52 to 57 are provided corresponding to the directions of the microphones H1 to H6 disposed horizontally on an outer periphery of the rotor 51 such that they contact with and slidably move on the resistance member 50. Sound signals obtained from the microphones H1 to H6 are inputted to the movable pieces 52 to 57, respectively.

When the horizontal panner is in such a state as shown in FIG. 12, a sound image is localized in the front. Here, if the rotor 51 is rotated in a direction in which the listener is directed, that is, if the arrow mark 43 shown in FIG. 11 is turned in the leftward or rightward direction using the mouse pointer, then the inputted microphones H1 to H6 are simultaneously level-distributed to the mixing buses L, Cm, R, Ls and Rs in an interlocking relationship with one another.

Figure 13:
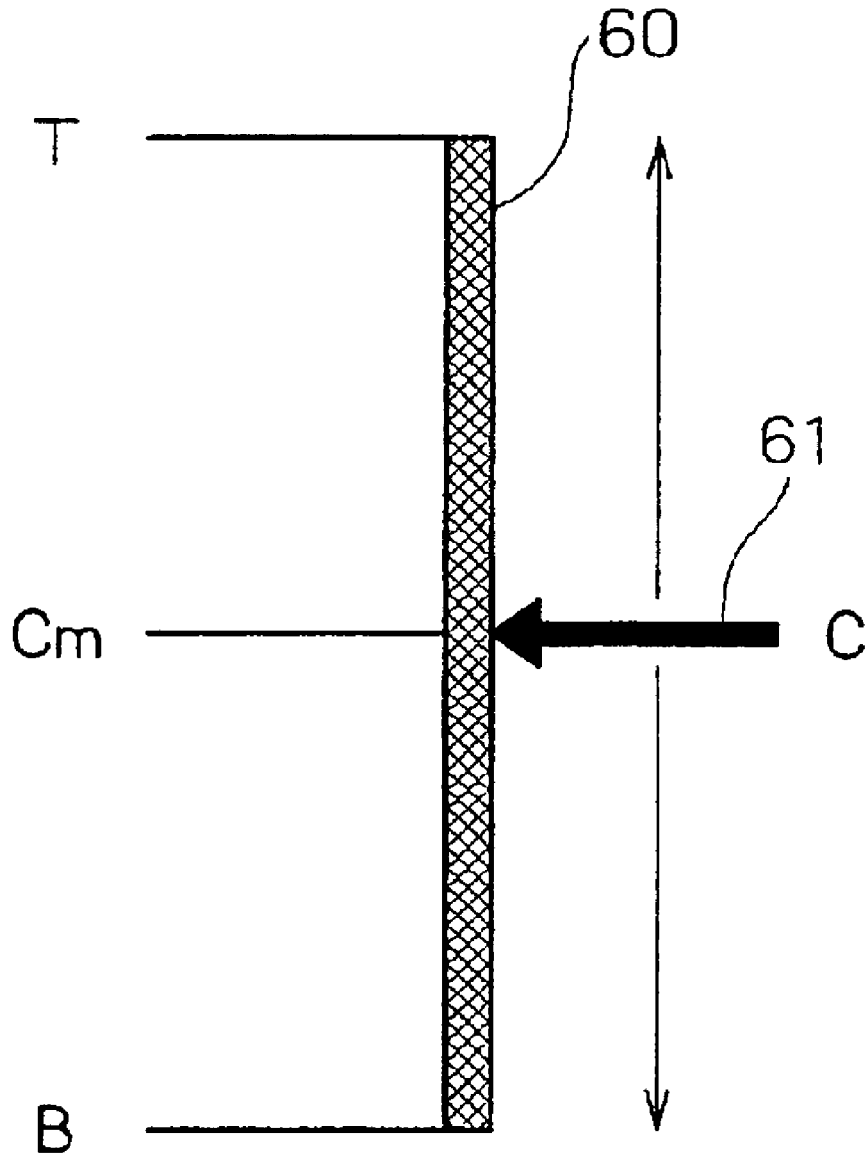
FIG. 13 is a diagrammatic view illustrating a relationship between vertical direction inputs and mixing buses.

FIG. 13 illustrates a relationship between the vertical direction input and the mixing buses.

Referring to FIG. 13, the vertical panner has a resistance member 60 formed in a straight line. Terminals to which sound signals from the microphones T and B disposed in the horizontal direction are connected to the opposite ends of the resistance member 60, and the mixing bus Cm is connected to a central position of the resistance member 60. Further, a movable piece 61 is provided which contacts with and slidably moves on the resistance member 60 linearly in accordance with a vertical instruction input from the direction inputting apparatus 40. The movable piece 61 is connected to the output channel C for the forward center.

When the vertical panner is in such a state as shown in FIG. 13, a sound image is localized at the front horizontal position. Here, if the movable piece 61 is moved upwardly or downwardly in a vertical direction in which the listener is directed, that is, if the mark 45 shown in FIG. 11 is moved in the upward or downward direction using the mouse pointer, then the inputted sound signals T, B and Cm are level-distributed to the output channel C for the forward center.

The foregoing description relates to a case wherein sound is collected in 6 channels in the horizontal direction. However, if it is intended to reproduce a sound field wherein a sound of an object of direction is discriminated more clearly, then the number of sound sources in the horizontal direction should be increased. Here, a relationship between sound sources and a reproduced sound field where the number of sound sources in the horizontal direction is changed, for example, to 8 is described as an example.

Figure 14:
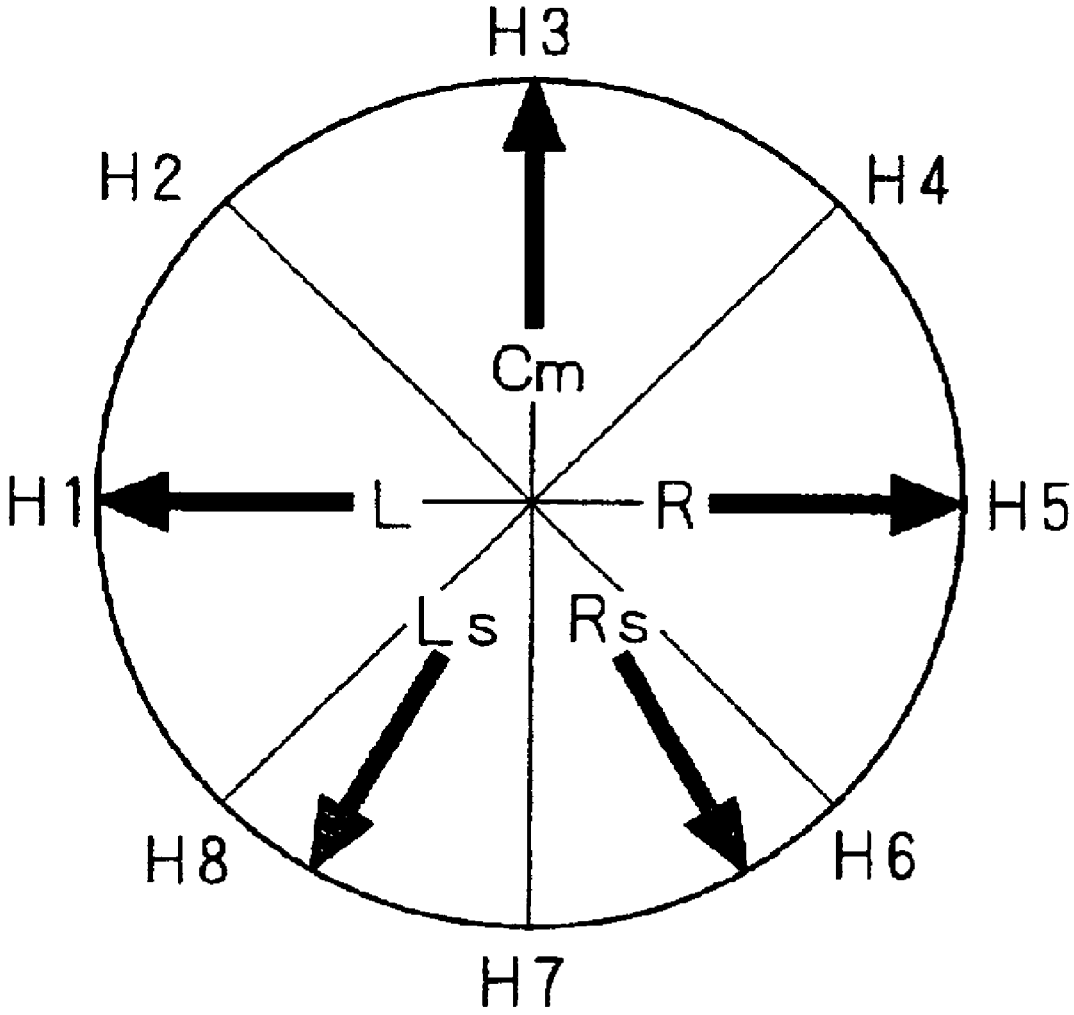
FIG. 14 is a diagrammatic view illustrating a relationship between sound sources and a reproduced sound field where an increased number of sound sources are used in a horizontal direction.

FIG. 14 illustrates a relationship between sound sources and a reproduced sound field where an increased number of sound sources for the horizontal direction are involved.

Here, the mixing buses L, Cm, R, Rs and Ls are the same as those described hereinabove where they are compatible with a 5.1 channel surround system. The sound sources are collected by eight microphones H1 to H8 directed in directions equally spaced from each other on a circumference to collect sound from all directions in the horizontal direction. The sound signals collected are level-distributed to the mixing buses L, Cm, R, Rs and Ls using coefficients determined based on attenuation characteristics between the channels.

In this manner, a surround sound field and a sound of an object of direction can be realized from at least three sound sources in the horizontal direction, and as the number of sound sources in the horizontal direction increases, a sound field wherein a sound of an object of direction is discriminated more clearly can be obtained.

Further, in the example described above, the surround sound field reproduction system is provided in a reproduction equipment side of the listener, and the listener decides a sound in which direction should be selected from among sound signals collected directly and supplied from omnidirectional sounds so that it may be the center of a surrounding sound field to be produced. In contrast, however, also it is possible to provide the surround sound field reproduction system on the sound source side.

For example, when omnidirectional sounds are distributed to a listener through an interactive broadcast (the Internet), it is possible to effect panning on the origination side in accordance with an instruction from the listener and distribute sound signals of the surround reproduction output channels L, C, R, Ls and Rs produced upon the panning as they are or after they are compressed and converted into sound signals of 2 channels so that the distributed signals may be received and reproduced as they are or after they are reproduced by the listener side. Also in the interactive environment just described, the listener can receive omnidirectionally collected sounds wherein a sound to which the listener is directed is forwardly localized and enjoy it in a desired surround sound field.

Further, while the surround sound field is described above taking a 5.1 channel surround system as an example, it can be similarly applied also to a surround sound system which uses virtual 5.1 channels or 5 channels of the headphone type 5.1 channel surround system. Further, the surround sound field reproduction system according to the present invention becomes more effective if it is used together with a video signal.

While a preferred embodiment of the present invention has been described using specific terms, such description is for illustrative purposes only, and it is to be understood that changes and variations may be made without departing from the spirit or scope of the following claims.

What is claimed is:

1. A surround sound field reproduction system for forwardly localizing a sound to which a listener is directed from among omnidirectionally collected sounds, comprising:

a plurality of horizontal panner means for individually receiving a plurality of sound signals of different input channels collected from sound sources distributed in a range of 360 degrees in a horizontal direction and distributing sound levels of the sound signals of the input channels in an interlocking relationship with each other to a plurality of output channels to control the horizontal localization;

vertical panner means for receiving a plurality of sound signals of different input channels collected from sound sources distributed in a range of 180 degrees in a vertical direction, changing a level distribution of the sound signals of the input channels to produce a sound signal and outputting the produced sound signal to an output channel for the front center to control the vertical localization; and a number of mixing buses determined with reference to the number of output channels necessary for a reproduced sound field, outputs of said horizontal panner means being level-distributed to all of said mixing buses, wherein said mixing buses include five buses for the forward left, the forward center, the forward right, the backward left and the backward right to be mixed for horizontal localization, and wherein said input channels include totaling eight channels including six channels for inputting sound signals of six directions collected from six directions of the forward left, the forward right, the left, the right, the backward left and the backward right in a horizontal direction and two channels for inputting upper and lower sound signals in a vertical direction, and said output channels include totaling five output channels including four output channels connected to four mixing buses for the forward left, the forward right, the backward left and the backward right and one output channel connected to the remaining mixing bus for the forward center for forward localization and an output of said vertical panner means to which the upper and lower input channels in the vertical direction are inputted.

2. A surround sound field reproduction system according to claim 1, wherein said output channels further include a sixth output channel for outputting low-frequency components included in all of the output channels so as to be applied to a 5.1 channel surround system.

3. A surround sound field reproduction system according to claim 1, further comprising direction inputting means for providing a panning operation instruction to said horizontal panner means and said vertical panner means so that the forward center may be localized to a direction in which the listener wants to listen to sound.

4. A surround sound field reproduction system according to claim 3, wherein said direction inputting means issues the instruction through a network.

5. A surround sound field reproduction system according to claim 1, wherein said input channels include six channels for inputting sound signals of six directions collected from six directions of the forward left, the forward right, the left, the right, the backward left and the backward right in the horizontal direction and two channels for inputting upper and lower sound signals in the vertical direction.

6. A surround sound field reproduction system according to claim 5, wherein the sound signals in the horizontal direction and the sound signals in the vertical direction are inputted through a digital recording and/or reproduction apparatus or a network.

7. A surround sound field reproduction method for forwardly localizing a sound to which a listener is directed from among omnidirectionally collected sounds, comprising the steps of:

receiving a plurality of sound signals of different input channels collected from sound sources distributed in a range of 360 degrees in a horizontal direction and distributing sound levels of the sound signals of the input channels in an interlocking relationship with each other to a plurality of output channels to control the horizontal localization;

receiving a plurality of sound signals of different input channels collected from sound sources distributed in a range of 180 degrees in a vertical direction, changing a level distribution of the sound signals of the input channels to produce a sound signal and outputting the produced sound signal to an output channel for the front center to control the vertical localization; and performing mixing of a number of sound signals determined with reference to the number of output channels necessary for a reproduced sound field, the sound signals of the input channels in the horizontal direction being level-distributed to all of the output channels, wherein the number of sound signals to be used for the mixing is five including sound signals for the forward left, the forward center, the forward right, the backward left and the backward right to be mixed for horizontal localization, and wherein said input channels include totaling eight channels including six channels for inputting sound signals of six directions collected from six directions of the forward left, the forward right, the left, the right, the backward left and the backward right in a horizontal direction and two channels for inputting upper and lower sound signals in a vertical direction, and said output channels include totaling five output channels including four output channels for the forward left, the forward right, the backward left and the backward right and one output channel for a mixing signal between the signal for forward localization of the forward center and input signals from the upper and lower input channels in the vertical direction.

8. A surround sound field reproduction method according to claim 7, further comprising a step of outputting low-frequency components included in all of the output channels through a sixth channel so as to be applied to a 5.1 channel surround system.

9. A surround sound field reproduction method according to claim 7, further comprising a direction inputting step of providing a panning operation instruction so that the forward center may be localized to a direction in which the listener wants to listen to sound.

10. A surround sound field reproduction method according to claim 9, wherein the panning operation instruction is issued through a network.

11. A surround sound field reproduction method according to claim 7, wherein said input channels include six channels for inputting sound signals of six directions collected from six directions of the forward left, the forward right, the left, the right, the backward left and the backward right in the horizontal direction and two channels for inputting upper and lower sound signals in the vertical direction.

12. A surround sound field reproduction method according to claim 11, wherein the sound signals in the horizontal direction and the sound signals in the vertical direction are inputted through a digital recording and/or reproduction apparatus or a network.

* * * * *